US005342429A

United States Patent [19]

Yu et al.

[11] Patent Number: 5,342,429

[45] Date of Patent: Aug. 30, 1994

[54] PURIFICATION OF MOLTEN ALUMINUM USING UPPER AND LOWER IMPELLERS

[75] Inventors: Ho Yu, Murrysville; Judith G. Stevens, McMurray, both of Pa.

[73] Assignee: Aluminum Company of America, Pittsburgh, Pa.

[21] Appl. No.: 57,156

[22] Filed: May 5, 1993

[51] Int. Cl.[5] ..... C22B 21/06

[52] U.S. Cl. ..... 75/680; 75/708; 266/225; 266/235

[58] Field of Search ..... 75/680, 708, 681, 225, 75/235; 266/217, 225, 235

[56] References Cited

U.S. PATENT DOCUMENTS 4,191,559 3/1980 Van Linden et al. ..... 75/680

5,160,693 11/1992 Eckert et al. ..... 75/708

FOREIGN PATENT DOCUMENTS 9202650 2/1992 European Pat. Off. ..... 75/708

*Primary Examiner*—Melvyn J. Andrews

*Attorney, Agent, or Firm*—Elroy Strickland

[57] ABSTRACT

Process and apparatus for improving fluxing gas dispersion in treating molten aluminum by increasing the fluxing gas surface area. The process includes the use of a molten body of aluminum and a gas dispersing unit in the body of molten aluminum, the dispersing unit having at least two, upper and lower dispersers (rotors) mounted on a shaft extending into the molten aluminum. The dispersing unit is rotated, and simultaneously with the rotating, a fluxing gas is added to the molten aluminum adjacent the lower disperser. The fluxing gas is dispersed by the lower disperser to provide finely divided bubbles and then re-dispersed with the upper disperser to effectively increase the fluxing gas surface area in the molten body.

6 Claims, 1 Drawing Sheet

PURIFICATION OF MOLTEN ALUMINUM USING UPPER AND LOWER IMPELLERS

FIELD OF THE INVENTION

This invention relates to fluxing processes that remove impurities from molten aluminum. More particularly, the invention relates to mechanical stirrers for removing impurities such as entrapped gases from molten aluminum.

BACKGROUND OF THE INVENTION

It has long been appreciated in the aluminum industry that sound products and good operating economics require treatment of molten metal to reduce certain types of defects in the product made from the metal caused by impurities in the metal prior to casting the metal. This is especially true for ingots which are subsequently worked to produce wrought products. One impurity commonly encountered is gas entrapped or dissolved in the metal during its melting and transfer. The gas is primarily hydrogen probably generated by moisture contacting the aluminum while molten. Likewise oxygen is acquired on the surface of molten aluminum which oxidizes the aluminum quite readily. Upon solidification of the metal, a considerable amount of gas and oxide particles are trapped within the metal. In subsequent fabrication, such entrapped impurities develop voids or discontinuities within the fabricated product that create weak areas in the product. The problem becomes more acute in high strength aluminum devices where voids and discontinuities not only create areas of weakness but can give rise to further defects, as explained below, which may constitute sufficient cause to reject the devices.

Other impurities commonly present in aluminum are dissolved trace elements, e.g., sodium, calcium, and lithium. This is introduced in the smelting process or in remelting of scrap metal. While trace elements, in the amounts generally encountered in aluminum, may not create severe difficulties in the final product itself, even miniscule amounts of trace elements give rise to serious problems in rolling and other drastic working operations especially in alloys containing magnesium. For instance, as little as 0.001% sodium or calcium can cause very serious edge cracking in the hot rolling of aluminum slabs, containing 2 to 10% magnesium, in a reversing mill.

It has been found that if the sodium and calcium content can be reduced to 0.0002% or less and especially to 0.0001% or less, on a commercial rather than mere laboratory basis, marked improvements in hot rolling can be realized such that heavy reductions of 20% or more per roll pass at temperatures of about 750° F. or more can be readily employed even on relatively thick stock without excessive edge cracking. In addition, such very low sodium and calcium levels foster increases of 20% or more in continuous casting rates for aluminum ingots.

Various methods have been proposed to reduce the oxide, trace elements, and gas content of molten aluminum and in this connection reference is made to U.S. Pat. No. 3,767,382, granted to Marshall Bruno et al and incorporated herein by reference, wherein a process is described in which molten aluminum is treated with selectively maintained salt flux in a compact system to decrease its oxide, gas, and trace elements. Gas removal is further aided by stripping with a non-reactive stripping gas. The system features an intensely agitated zone for contacting the metal and the salt flux followed by a quiet separation zone. Molten metal introduction, agitation, and flux characteristics are utilized to achieve required efficiencies.

U.S. Pat. Nos. 3,839,019 and 3,849,119 granted to Marshall Bruno et al and both incorporated hereby reference describe processes in which aluminum is purified by chloridizing a molten body of aluminum. High metal chloridization rates are achieved in a system wherein chlorine utilization efficiency is 100% or very closely approaches this level. The system includes a chlorine-metal contacting technique which includes an agitator and which controls and maintains contacting conditions to optimize efficiency.

U.S. Pat. No. 4,390,364 granted to Ho Yu and incorporated herein by reference describes a method of treating molten metal containing suspended particles typically comprising buoyant liquid such as liquid salt or suspended phases are treated to coalesce or agglomerate the particles so that they are more readily separated by gravity in the molten metal.

Each of these processes includes some provision for agitating or stirring a chlorinaceous fluxing gas in the molten metal to disperse the gas and thereby increase its surface area and effectiveness in removing impurities. These methods have achieved commercial success. However, lowering the gas and trace element content in aluminum alloys is very difficult.

One example of the difficulty in reducing the trace element content by chlorination is that the magnesium present in the aluminum alloy melt reacts simultaneously with the chlorine. This occurs even though chlorine, or the reaction product of chlorine with aluminum, aluminum chloride, react with sodium and calcium preferentially over magnesium at equilibrium conditions.

It is believed that chlorine released in the melt would first be expected to largely form aluminum chloride because aluminum is by far the major component in the melt. Next in sequence, some of the aluminum chloride may encounter and react with magnesium in the melt to form magnesium chloride because magnesium is usually more concentrated than the other melt components capable of reacting with aluminum chloride. Finally, if contact with the metal is maintained long enough, the magnesium or aluminum chlorides encounter the trace amounts of sodium and calcium and react to form the final equilibrium product, sodium, and calcium chlorides. The rate of chlorination and magnesium concentration are factors determining how far and how rapidly reaction proceeds through this sequence to the final equilibrium product, sodium and calcium chlorides.

At commonly used chlorination rates, final equilibrium is difficult to achieve without long contact times. Accordingly, it has been difficult to achieve extremely low sodium and calcium levels under commercial production plant conditions which require comparatively large amounts of molten metal to be treated rather rapidly.

In view of the foregoing, it is obviously desirable to be able to reduce all three mentioned types of impurities, oxide particles, trapped gas, and chemical impurities such as calcium, sodium, magnesium, and lithium and the like, in a continuous process and at a single station or operation. It is also highly desirable that any such process be compatible with existing level pour molten metal transfer systems. As is known, aluminum's affinity for oxygen has fostered widespread use in the aluminum industry of substantially horizontally level molten metal transfer systems to avoid the turbulence and surface agitation, and resulting oxide formation, which could be encountered if the metal were permitted to drop significant heights during transfer.

SUMMARY OF THE INVENTION

It is an objective of the invention to provide an improved fluxing process for removing impurities from molten metals such as magnesium and aluminum alloys.

It is a further objective of the invention to provide a disperser for more efficiently dispersing larger amounts of fluxing gas in molten magnesium and aluminum alloys.

In accordance with these objectives, improved process for fluxing gas dispersion in treating molten metal increases the surface area of the fluxing gas. The process includes the use of a body of molten metal and a gas dispersing unit located in the body of molten metal, the dispersing unit comprising at least an upper and a lower disperser in the form of a generally circular rotor or impeller. The dispersing unit is rotated, and simultaneously therewith, a fluxing gas is added adjacent or in the region of the lowermost disperser. The fluxing gas is dispersed with the lowermost disperser to provide finely divided bubbles and then re-dispersed, when coalescence of the bubbles occurs, using one or more upper dispersers to effectively increase the fluxing gas surface area in the molten body thereby increasing the effectiveness of the fluxing gas within the system.

In a preferred embodiment, the molten metal is aluminum and an upper disperser is located about ten inches below the upper surface of the molten aluminum. The fluxing gas comprises a chlorine and/or a non-reactive gas selected from the group consisting of argon and nitrogen gases and mixtures thereof. The fluxing gas is added to the molten aluminum at at least 0.005 SCFH (standard cubic feet per pound of metal). Suitable rotational speeds for the dispersers are about 100 to 500 rpm, and the rotors can have different diameters and be operated at different speeds.

BRIEF DESCRIPTION OF THE DRAWINGS

The objectives and advantages of the invention will be better understood from consideration of the following detailed description and the accompanying drawings in which.

DETAILED DESCRIPTION OF A PREFERRED EMBODIMENT

Figure 1:
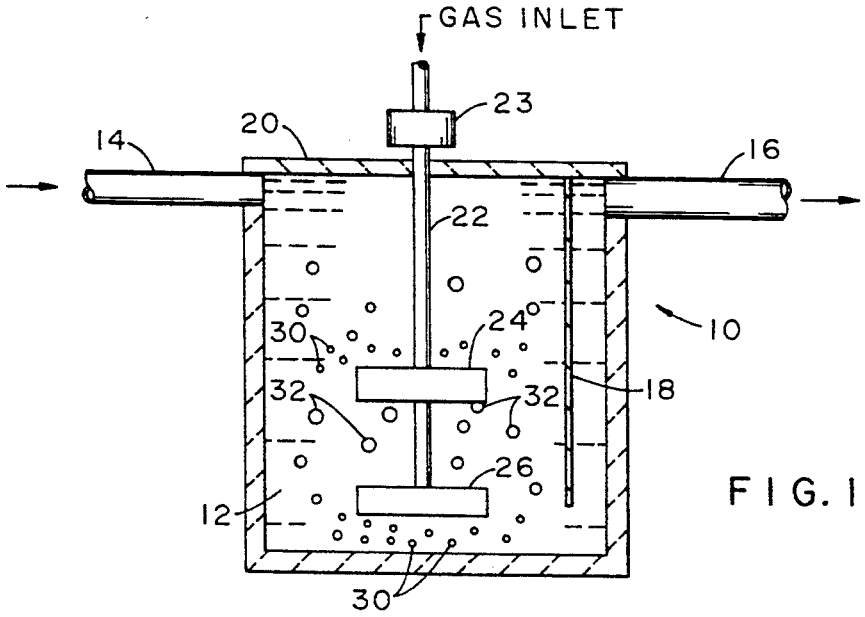
FIG. 1 is a diagrammatic view of two rotor fluxing system for removing impurities from molten metal.

Referring now to FIG. 1 of the drawings, a vessel 10 is shown containing a supply of molten aluminum 12. Vessel 10 comprises a system for purifying the aluminum, which enters the vessel through inlet conduit 14 and exits the vessel through outlet 16. Before exiting at 16, the molten metal travels beneath a baffle 18 to reduce oxide particles, salt particles, and fluxing gas from entering the exit stream 16. An upper wall 20 of vessel aids in this effort in that 20 seals the interior of the vessel from oxidizing moisture pickup influences.

Extending into vessel 10 is shaft 22 suitable for connecting to a motor 23 for rotating the shaft and two horizontally disposed, upper and lower impellers or rotors 24 and 26 vertically displaced on and connected to the shaft. The configuration of rotors 24 and 26 used in performing tests on the rotors in a molten bath of aluminum are those disclosed in U.S. Pat. No. 3,839,019 to Bruno et al showing a twelve-inch diameter impeller comprised of turbine blades extending radially outwardly from a center hub. However, the rotors may have other configurations and sizes so long as they are effective in dispersing bubbles of fluxing gas in the molten metal in a manner that increases the number of small gas bubbles such that large surface areas of the gas bubbles are provided that enable ample contact with the metal to strip hydrogen and other impurities from the metal.

In addition, though only two rotors are shown in FIG. 1, additional rotors can be mounted on shaft 22 to re-disperse fluxing gas bubbles in the manner of the invention.

Preferably, fluxing gas is directed into the molten aluminum 12 through shaft 22, which, of course, requires the shaft to be hollow, the gas exiting the lower end of the shaft and beneath the lowermost rotor 26. As seen in FIG. 1, which is intended to be a general representation of the apparatus and schematic and illustrative, the lower rotor when rotated in and against the gas creates relatively small bubbles 30 beneath the lower rotor, which bubbles travel downwardly and outwardly from the rotor. The bubbles then begin to rise in the molten metal, and as they rise, they tend to coalesce, thereby creating large size bubbles, as indicated in FIG. 1 by numeral 32; this reduces the available surface area for contacting the molten metal and thus reduces the ability of the gas to strip and remove unwanted gases such as hydrogen, inclusions, and elements such as calcium, sodium, and lithium from the molten metal.

Still referring to FIG. 1, as the large bubbles 32, along with any remaining small bubbles 30, rise toward the upper rotor 24, rotor 24 rotates into and against the large oncoming bubbles to redistribute and fragment the bubbles that may have coalesced. The creation and recreation of small bubbles increases substantially the area available for contacting the molten metal for removing impurities from the metal.

Figure 2:
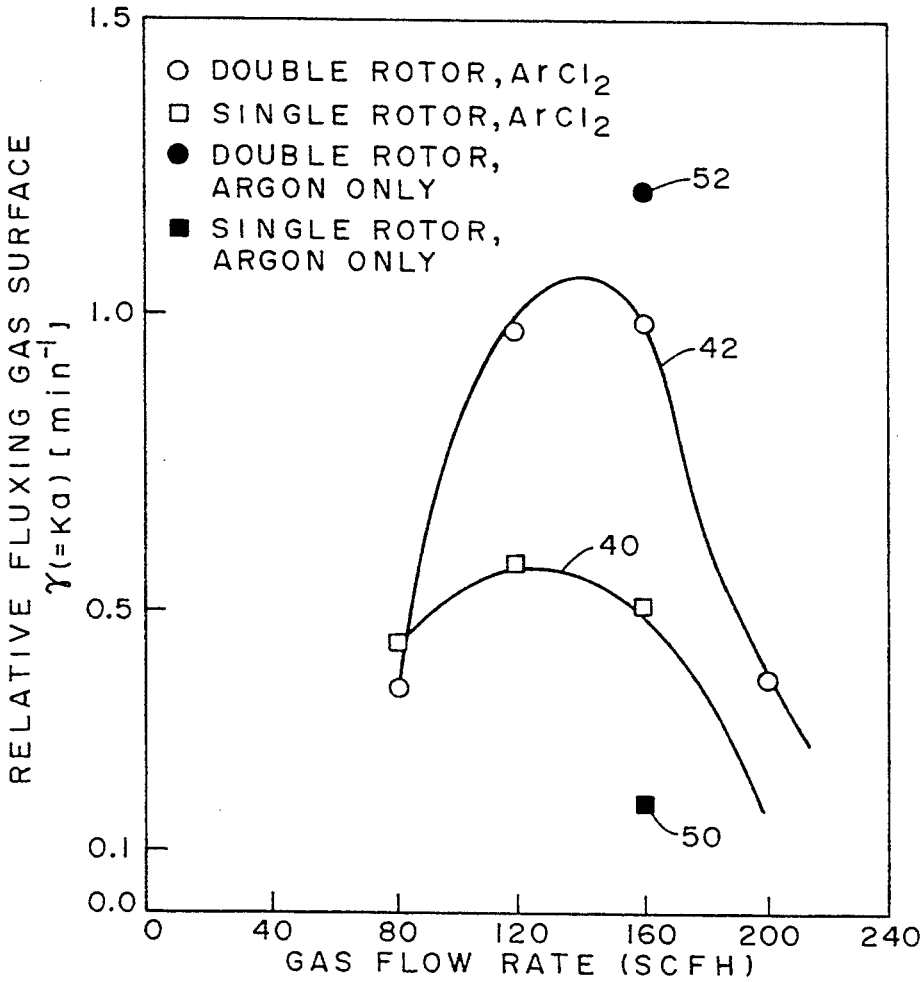
FIG. 2 is a graph showing gas flow rates versus fluxing gas surface area for single and double rotor dispersers.

The effectiveness of the impurity removal process, using two rotors, is shown by the graph of FIG. 2. The graph is a plot of gas flow rates in terms of standard cubic feet per hour (SCFH) against relative fluxing gas surface area, as expressed by the equation $\gamma(=Ka)[\text{min.}^{-1}]$, wherein "K" is the mass transfer coefficient for hydrogen or reaction rate constant in the case of trace elements, such as sodium and calcium; "a" is the area of the interface between the fluxing gas and the molten metal. In using a single rotor and an inert argon gas only, test data 50 shows a relatively low interfacial area at a gas flow rate of 160. When two rotors are used, the interfacial surface area increased substantially, as indicated by numeral 52 in FIG. 2. An inert gas by itself was found to be effective for removing hydrogen from molten aluminum. Such a gas can be argon, nitrogen, or mixtures thereof.

Curve 42 in FIG. 2 plots the test data for the two rotor unit of FIG. 1 using a mixture of argon and chlorine gases and gas flow rates of 80 through 200 SCFH. At a gas flow rate of greater than 80 SCFH, the effectiveness and efficiency of the two rotor systems over that of the single rotor, as shown by curve 40, is clear and substantial. And, this was accomplished at one location using a minimum of fluxing time and amounts of fluxing gases. For low gas flow rates (80 SCFH and less), a single rotor is adequate for the task so that no increase is observed when the dual rotor unit was used.

For both tests, i.e., using the single and double rotor, the rpm of the rotor was 125. However, rotor speed can be in the range of 50 to 500 rpm depending upon the size of container 10, the alloy of the molten metal, the type and amount of impurities contained in the metal, and the types and flow rates of fluxing gases.

Further, in the above tests, rotors 24 and 26 were identical in size and configuration and were rotated in the same direction. The rotors can be rotated in opposite directions using a more complicated shaft and drive system than the single shaft 22, and the rotors can be of different sizes and configurations. The position of the lower most rotor (26) for the tests was one inch above the lower edge of baffle 18, while the distance between the rotors was two inches. The thickness of both rotors was two inches, with the height of the molten bath above the upper rotor 24 being at a minimum of ten inches.

While the invention has been described in terms of preferred embodiments, the claims appended hereto are intended to encompass all embodiments which fall within the spirit of the invention.

What is claimed is:

1. A method of gas fluxing molten aluminum, said method comprising:

(a) locating upper and lower rotatable dispersers in said body of molten aluminum;

(b) adding a fluxing gas to said molten aluminum in the region of the lower disperser, said fluxing gas and molten aluminum having an initial interfacial area between them; and (c) rotating said upper and lower dispersers in an rpm range of from about 50 to 500 to disperse said gas in a manner that is effective to increase substantially the removal of impurities in the molten aluminum by virtue of a substantial increase in the interfacial area of the fluxing gas and molten aluminum.

2. The method of claim 1 in which said fluxing gas comprises a halogenous gas.

3. The method of claim 1 in which the fluxing gas comprises a non-reactive gas selected from the group consisting of argon, nitrogen, or mixtures thereof.

4. The method of claim 1 in which said fluxing gas comprises a reactive halogenous and a non-reactive gas selected from the group consisting of argon gas, nitrogen gas, or mixtures thereof.

5. A method of gas fluxing molten aluminum, said method comprising:

(a) adding a fluxing gas to said molten aluminum in a lower region of the molten aluminum, said fluxing gas comprising a reactive or halogenous and/or a non-reactive gas selected from the group consisting of argon gas, nitrogen gas, or mixtures thereof, said fluxing gas being added into said molten aluminum at a rate of at least 0,005 SCFH, and providing an initial interfacial area between the gas and molten aluminum; and (b) rotating upper and lower dispersers located in said molten aluminum at about 50 to 500 rpm to disperse said gas in a manner that is effective to increase substantially the removal of impurities in the molten aluminum by virtue of a substantial increase in the interfacial area of the fluxing gas and molten aluminum.

6. A method of gas fluxing molten aluminum, said method comprising:

(a) providing a body of molten aluminum;

(b) providing a gas dispersing unit in the body of molten aluminum, the dispersing unit having at least two impeller dispersers mounted on a shaft projecting into said aluminum to provide an upper and lower disperser, said upper disperser being located about ten inches below the upper surface of said body of molten aluminum;

(c) rotating said dispersing unit at a speed of from about 50 to 500 rpm;

(d) simultaneously with said rotating, adding a fluxing gas in the vicinity of said lower disperser, said fluxing gas comprising a reactive or halogenous and/or a non-reactive gas selected from the group of argon gas, nitrogen gas, or mixtures thereof, said fluxing gas being added into said molten aluminum at a rate of at least 0.005 SCFH;

(e) dispersing said fluxing gas with said lower disperser to provide finely divided bubbles; and (f) re-dispersing coalesced fluxing gas with said upper disperser, as the fluxing gas rises to the surface to effectively increase the fluxing gas surface area in said molten aluminum.

* * * * *